US006141843A

United States Patent [19]

Hegenbarth et al.

[11] Patent Number: 6,141,843

[45] Date of Patent: Nov. 7, 2000

[54] APPARATUS AND METHOD FOR STUFFER BOX CRIMPING A SYNTHETIC YARN

[75] Inventors: Jörg Hegenbarth, Remscheid; Klaus Gerhards, Hückeswagen; Frank Bäcker, Solingen, all of Germany

[73] Assignee: Barmag AG, Remscheid, Germany

[21] Appl. No.: 09/384,161

[22] Filed: Aug. 27, 1999

[30] Foreign Application Priority Data

Aug. 27, 1998 [DE] Germany ..... 198 38 896

[51] Int. Cl.[7] ..... D02G 1/12; D02G 1/20

[52] U.S. Cl. ..... 28/263; 28/255; 28/256; 28/266

[58] Field of Search ..... 28/255, 256, 257, 28/263, 266, 269, 250, 262, 265, 267, 268, 271

[56] References Cited

U.S. PATENT DOCUMENTS

| | | | |
|---|---|---|---|
| 3,636,149 | 1/1972 | Tambini | 28/269 |
| 3,751,778 | 8/1973 | Grosjean et al. | 28/255 |
| 3,911,538 | 10/1975 | Vidal et al. | 28/255 |
| 4,118,843 | 10/1978 | Schippers et al. | 28/255 |
| 4,301,578 | 11/1981 | Dammann et al. . | |
| 4,315,355 | 2/1982 | Stanley | 28/255 |
| 5,054,173 | 10/1991 | Schafer | 28/263 |
| 5,251,363 | 10/1993 | Gerhards et al. | 28/263 |
| 5,351,374 | 10/1994 | Nabulon et al. . | |
| 5,579,566 | 12/1996 | Burkhardt et al. . | |

FOREIGN PATENT DOCUMENTS

| | | |
|---|---|---|
| 0 539 808 B1 | 5/1993 | European Pat. Off. . |
| 0 554 642 B1 | 8/1993 | European Pat. Off. . |
| 26 32082 C2 | 1/1978 | Germany . |

*Primary Examiner*—Amy B. Vanatta
*Attorney, Agent, or Firm*—Alston & Bird LLP

[57] ABSTRACT

An apparatus and a method of stuffer box crimping a synthetic multifilament yarn, wherein the yarn is advanced in a conveying nozzle by means of a heated conveying gas into a stuffer box and compressed to a yarn plug. At the outlet of the stuffer box, a pair of rolls form a conveying gap for advancing the yarn plug and which has a width smaller than the cross section of the plug leaving the stuffer box so as to compress the yarn plug. The internal passage of the stuffer box is constructed with a cross section that increases in the direction of advance in such a manner that no significant cohesive force develops on the yarn plug, and the resistance to the forward pressure in the yarn plug resulting from the heated conveying gas is provided essentially only by the force on the yarn plug generated by its compression in the conveying gap.

19 Claims, 4 Drawing Sheets

APPARATUS AND METHOD FOR STUFFER BOX CRIMPING A SYNTHETIC YARN

BACKGROUND OF THE INVENTION

The present invention relates to an apparatus for stuffer box crimping a synthetic multifilament yarn, as well as a method of stuffer box crimping a synthetic yarn. An apparatus and method of this general type are known from DE 26 32 082.

In the stuffer box crimping process, a multifilament yarn is advanced by means of a conveying nozzle into a stuffer box, compressed to a yarn plug and thereby crimped. To this end, the conveying nozzle receives a conveying medium, preferably a hot gas, which advances the yarn inside a yarn channel to the stuffer box. Inside the stuffer box, the yarn forms a plug. In so doing, the yarn comes to lie in loops on the surface of the yarn plug, and it is compressed by the conveying medium that is allowed to escape from the stuffer box through slots upstream of the yarn plug. Subsequently, the yarn plug is guided out of the stuffer box and cooled by means of a cooling device downstream thereof. After cooling, the yarn plug is disentangled to a form crimped yarn.

The crimp in the yarn is influenced in its intensity primarily by the plug formation and by the thermal treatment of the yarn plug. To form the yarn plug in the stuffer box, a cohesive force or counteracting force on the yarn plug is therefore generated in a direction opposite to the pressure of the conveying medium. To make it possible that the formation and treatment of the yarn plug is as constant as possible, it is now necessary to maintain a certain ratio of the conveying pressure to the counteracting force.

DE 26 32 082 and U.S. Pat. No. 4,301,578 disclose an apparatus and a method, wherein the counteracting force is determined from the friction between the yarn plug and the stuffer box wall, as well as from the conveying speed of a pair of rolls arranged at the outlet of the stuffer box. In this apparatus and method, the problem arises that as running time increases, the surfaces of the stuffer box wall change in their frictional behavior due to wear, which is bound to entail a change in the counteracting force.

EP 0 554 642 and U.S. Pat. No. 5,351,374 disclose, for example, an apparatus, wherein the counteracting force for forming a plug results exclusively from the friction between the plug and the stuffer box. However, this leads to a change in the counteracting force after a short running time. Constant measures of adaptation are in this instance unavoidable.

It is therefore the object of the invention to improve the known apparatus and the known method for stuffer box crimping a synthetic multifilament yarn such that they ensure a uniform formation of the yarn plug and a uniform thermal treatment of the yarn plug.

A further object of the invention it to produce a lintfree filament assembly.

SUMMARY OF THE INVENTION

The above and other objects and advantages of the present invention are achieved by the provision of a yarn treatment apparatus which comprises a yarn conveying nozzle, and a stuffer box disposed adjacent the outlet end of the nozzle, with the cross-section of the yarn passage in the stuffer box increasing in the direction of the yarn advance, such that no significant cohesive force is imparted to the yarn by the passage wall. A pair of rolls are rotatably mounted adjacent the outlet end of the stuffer box passage, with the rolls defining a conveying gap which is less than the diameter of the yarn plug which is formed in the stuffer box.

The invention distinguishes itself in that irrespective of the surface quality and wear of the yarn guiding or plug guiding elements, the conditions for treating the yarn plug are substantially always the same. To minimize the influence of the friction between the yarn plug and the stuffer box wall, the apparatus of the present invention comprises a stuffer box with a cross section that increases in the direction of advance. Thus, the plug is caused to advance through the stuffer box substantially free of resistance without a significant cohesive force. The cross sectional enlargement may be continuous or in steps. To build up a counteracting pressure necessary for forming the plug, the pair of rolls at the outlet of the stuffer box has a conveying gap of a width s, which is smaller than the diameter D of the plug, when it leaves the stuffer box. In this connection, the plug diameter D is determined by the cross section of the stuffer box in its inlet region. The inlet region of the stuffer box extends substantially from the inlet into the stuffer box to the beginning of the air outlet openings, which are formed preferably as elongate slots in the stuffer box wall. When compared with the overall length of the stuffer box, the inlet region is in the upper half, preferably in the upper third or upper fourth of the stuffer box. The narrow conveying gap between the rolls, causes the plug to be compressed substantially crosswise to its direction of advance. Thus, besides the circumferential speed of the paired rolls, the counteracting force is dependent on the cross sectional change of the yarn plug. Under a uniform conveying pressure and at a uniform circumferential speed of the paired rolls, a substantially constant counteracting pressure is generated for forming the plug, which is substantially independent of the surface quality and wear of plug-guiding elements.

Likewise, the additional compression of the yarn plug positively influences the intensity of the crimp in the yarn. With a compression as little as 10%, it is possible to notice this effect. In this connection, the conveying gap of the paired rolls has a minimum width s of about 90% of the plug diameter. Preferably, the conveying gap between the paired rolls is adjusted to a width s, which is smaller than 60% of the plug diameter D, namely $s<0.6 \cdot D$. Thus, it is possible to realize compressions of the plug in the conveying gap of more than 30%.

To minimize the cohesive force that acts upon the plug by friction in the region of the stuffer box, it is advantageous to make the stuffer box conical, so that the cross section of the stuffer box enlarges continuously. In this connection, an apex angle of the stuffer box should be at least 2°, preferably at least 5°, but preferably smaller than 10°.

To build up a relatively high counteracting pressure for forming the yarn plug, the conveying gap may be formed by a pair of cylindrical rolls.

The pair of rolls may be provided with a rough surface structure, such as axially directed grooves. This provides the advantage that the yarn plug exits from the stuffer box at a constant speed without slip between the paired rolls and the yarn plug. In addition, the rough surface structure on the circumference of the rolls accomplishes a reliable engagement of the yarn plug. The yarn plug is uniformly compressed over its cross section, and safely conveyed between the paired rolls without a slip occurring between the yarn plug and one of the paired rolls.

Especially advantageous is the embodiment of the apparatus according to the invention, wherein the surface structure of the rolls is a gear-tooth system. The gear-tooth system may be both of the straight tooth type and of the helical tooth type. This permits further breaking up the surface of the yarn plug, which improves in particular the subsequent cooling of the yarn plug.

The further development of the apparatus according to the invention is especially suited for adjusting the direction of advance. In particular, the use of rolls with an identical circumference in the region of contact with the yarn plug permits realizing a particularly straight direction of advance of the plug at an identical operating speed of the roll. In comparison therewith, the different circumferential regions of the rolls enable a deflected path of the yarn plug. In addition, when the yarn plug is conveyed by rolls with different diameters, it is loosened due to different circumferential speeds and loopings, which leads in the subsequent cooling to a uniform and more intensive cooling of the yarn plug.

To be able to adjust the yarn plug formation optimally at the startup of the process, the apparatus offers the possibility of changing the circumferential speed of the rolls. With that, it is possible to influence the dwelling time of the yarn plug inside the stuffer box substantially. In this process, it is also possible to drive both rolls at the same or different rotational speeds.

In a further embodiment of the apparatus, it is possible to change the counteracting pressure by varying the width of the conveying gap. To this end, at least one of the paired rolls can be changed in its position. This permits narrowing the width of the conveying gap for increasing the counteracting pressure or enlarging it for decreasing the counteracting pressure.

In a particularly advantageous embodiment of the apparatus the yarn duct in the yarn conveying nozzle has a cross section that continuously increases with a substantially constant apex angle from a narrowest point to the outlet end thereof. This renders it possible to advance the yarn into the stuffer box at a very high velocity of flow. For example, if the conveying medium is accelerated at the narrowest point of the yarn duct to a speed of approximately the speed of sound, it will be possible, due to the construction of the yarn duct, that the velocity of flow continues until reaching the stuffer box. Inside the stuffer box, the conveying medium undergoes an expansion. In addition, the high velocity of flow accomplishes that inside the stuffer box, the plug evenly fills the cross section of the stuffer box, which increases in the direction of advance.

The stuffer box may be formed by a wall of increasing thickness in the direction of advance, so that the stuffer box exhibits outwardly a conical shape. In the wall, a plurality of elongate slots are arranged in even distribution over the circumference. These slots extend through the wall parallel to the direction of advance. This construction of the stuffer box makes it possible to produce in particular a lintfree yarn. It is known that when the conveying medium expands directly at the inlet into the stuffer box, individual filaments of the yarn are blown into the elongate slots. The conical stuffer box with a wall thickness increasing in the direction of advance causes the individual filaments to be pulled into the yarn plug safely and evenly, as same continues to advance. Thus, the yarn plug leaving the stuffer box contains no projecting individual filaments, and distinguishes itself in particular by a stable assembly of filaments.

To cool the yarn plug uniformly after the heat treatment and, thus, to set the crimp, the yarn plug advances with a surface compressed by the roll surface over the cooling surface of a cooling drum.

This accomplishes on the one hand a uniform contact with the cooling device over the entire yarn cross section and on the other hand a uniform flow of the cooling medium through the plug.

BRIEF DESCRIPTION OF THE DRAWINGS

In the following, an embodiment is described in greater detail with reference to the accompanying drawings, in which.

DETAILED DESCRIPTION OF THE PREFERRED EMBODIMENTS

Figure 1:
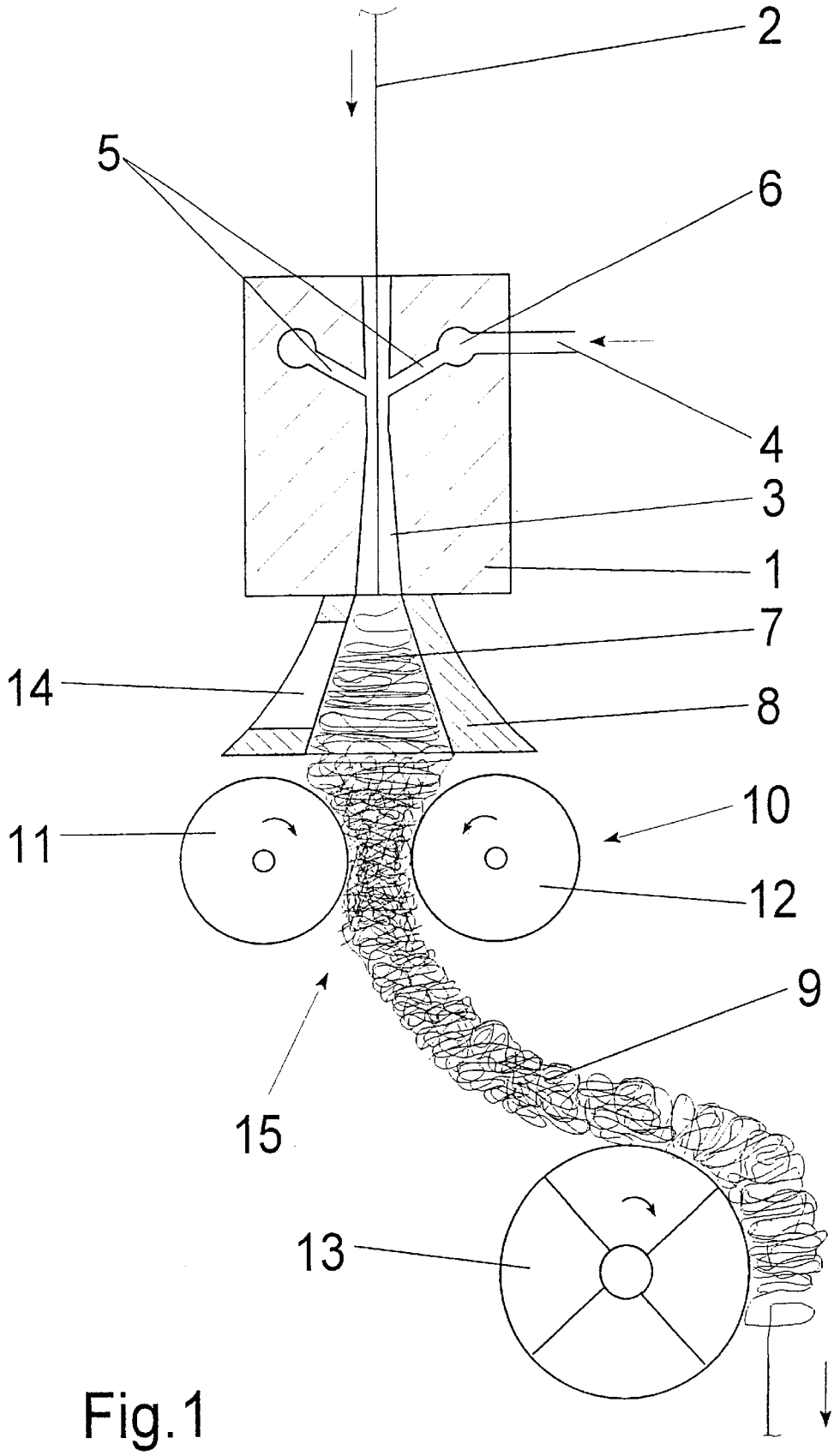
FIG. 1 is a schematic sectional view of a first embodiment of a stuffer box crimping apparatus according to the invention.

FIG. 1 illustrates a first embodiment of an apparatus for stuffer box crimping a synthetic yarn. The apparatus comprises a conveying nozzle 1 with a yarn duct 3 in its center. The central yarn duct 3 is constructed in the same manner as in the apparatus disclosed in EP 0 539 808 and U.S. Pat. No. 5,579,566, which are herewith incorporated by reference.

The yarn duct comprises essentially two sections, which are separated from each other by a narrowest cross section. In the first section, upstream of the narrowest cross section, a plurality of nozzle bores 5 terminate in yarn duct 3. The nozzle bores 5 connect to an annular chamber 6, and the annular chamber 6 connects, via a supply line 4, to a pressure medium supply (not shown).

In the second section downstream of the narrowest cross section, the yarn duct 3 widens with a very small apex angle that ranges preferably between 0.5° and 5°. A stuffer box 7 connects directly to the end of yarn duct 3. The stuffer box 7 is formed by a wall 8. In comparison with the yarn duct, the stuffer box has in its inlet region a somewhat larger cross section, which widens substantially continuously in direction of advance to the exit of the yarn plug. To this end, the stuffer box wall is made conical in the interior with an apex angle greater than 2°, preferably greater than 5°. A plurality of elongate slots 14 extend, evenly distributed over the circumference, through wall 8 of the stuffer box. The elongate slots 14 extend substantially over the entire length of stuffer box 7. Outwardly, the stuffer box wall 8 is likewise made conical in such a manner that it has a thickness that enlarges in the direction of advance. The thickness of the wall may increase both continuously and in steps.

Downstream of the stuffer box a pair of rolls 10 is arranged. The pair of rolls 10 consists of rolls 11 and 12. The rolls 11 and 12 form between them a conveying gap 15. The conveying gap 15 has a width s, which is smaller than the diameter D of the yarn plug (compare FIG. 2). The conveying gap is adjusted to a width, which is of a range from $s<(0.9\cdot\text{times plug diameter } D)$, preferably $s<(0.6\cdot\text{times plug diameter } D)$. The rolls 11 and 12 are driven at the same rotational speed.

Downstream of the paired rolls 10, a cooling device 13 is provided. The cooling device 13 is a rotating drum, over whose circumference a yarn plug 9 advances to a point of departure for purposes of being cooled. At the point of departure, the yarn plug 9 is disentangled to a yarn.

In the apparatus shown in FIG. 1, a yarn 2 is advanced by means of a heated conveying medium through the yarn duct 3 into the stuffer box 7. To this end, the heated conveying medium, preferably in the form of hot air or vapor, enters the yarn duct 3 through nozzle bores 5. At the beginning of the process, the stuffer box 7 is closed at its outlet end, so that a plug 9 forms by depositing the yarn 2 in loops and coils. The conveying medium exiting from the yarn duct 3 at approximately the speed of sound, is allowed to leave through elongate slots 14 arranged in the wall of stuffer box 7 upstream of the yarn plug. After a yarn plug has formed in stuffer box 7, the stuffer box is opened, and the process can start. In so doing, the yarn plug initially propagates to the conveying gap 15 of paired rolls 10. In the conveying gap 15, the yarn plug 9 is compressed between the surfaces of rolls 11 and 12. This compression that amounts to at least 10%, preferably 30%, applies a counteracting force that is needed in the stuffer box 7 for forming yarn plug 9. It has thus been possible to texture with advantage, for example, a yarn of polypropylene with a yarn plug diameter of 5 mm and a width of the conveying gap of 2 mm. In the case of a yarn of polyamide, for example, the yarn plug with a diameter of 4 mm advanced for crimping through a gap of 2 mm.

Subsequently, the paired rolls 10 advance the yarn plug 9 to the cooling drum 13. The yarn plug 9 loops about the circumference of cooling drum 13. To be able to take in cooling air, the cooling drum 13 comprises in its jacket openings. The cooling air flows through the plug. At the end of cooling zone, the yarn plug 9 is disentangled to the crimped yarn, which is withdrawn by a feed system not shown, and supplied, for example, to a takeup device.

Figure 2:
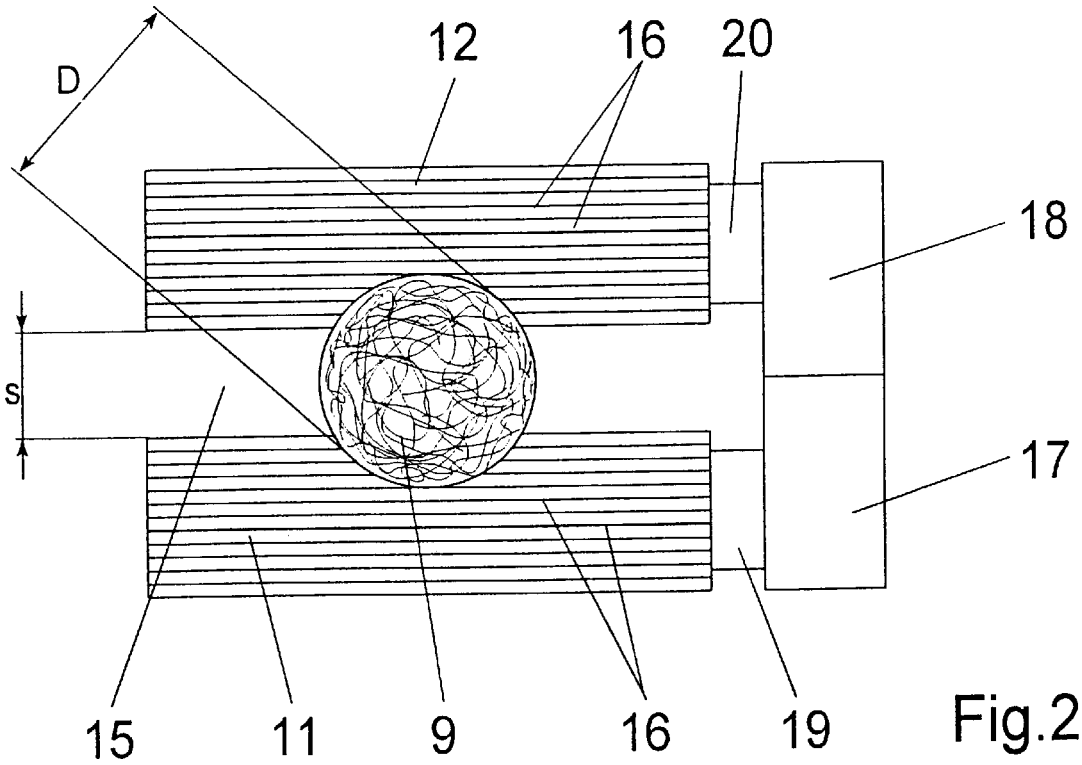
FIG. 2 is a top view of a pair of rolls for compressing a yarn plug.

FIG. 2 is a schematic top view of a pair of rolls, as could be used, for example, in the apparatus of FIG. 1. The paired rolls include rolls 11 and 12. The roll 11 connects via a shaft 19 to a drive 17. The roll 12 connects with a shaft 20 to a drive 18. The rolls 11 and 12 extend in one plane facing each other, and they form between them a conveying gap 15. The rolls 11 and 12 are made cylindrical, so that the conveying gap has a substantially constant width s over the length of the roll.

At this point, it should be noted that a conical or profiled shape of the rolls permits making the conveying gap of a width that differs over the length of the rolls.

On their circumferential surface, the rolls shown in FIGS. 2 are provided with a plurality of axially extending grooves 16. The grooves 16 are arranged in the surface evenly distributed over the circumference of rolls 11 and 12. As a result of the profiled surface structure of roll 11 and 12, which are driven independently of each other by drives 17 and 18, the yarn plug is reliably engaged on in its surface and pulled into the conveying gap 15. After leaving the stuffer box, the yarn plug 9 exhibits a substantially circular cross section with a diameter D. Due to the narrow conveying gap, the yarn plug is compressed by the paired rolls. In so doing, the plug density undergoes a change, which improves the subsequent cooling.

The rolls 11 and 12 of the pair shown in FIG. 2 are made of the same size and are normally driven at the same rotational speed. This effects a uniform, substantially straight-line advance of the yarn plug 9. However, it is also possible to drive rolls 11 and 12 at different rotational speeds. In this case, the yarn plug is deflected after leaving the conveying gap in the direction toward the roll that is driven at the lower circumferential speed.

Figure 3:
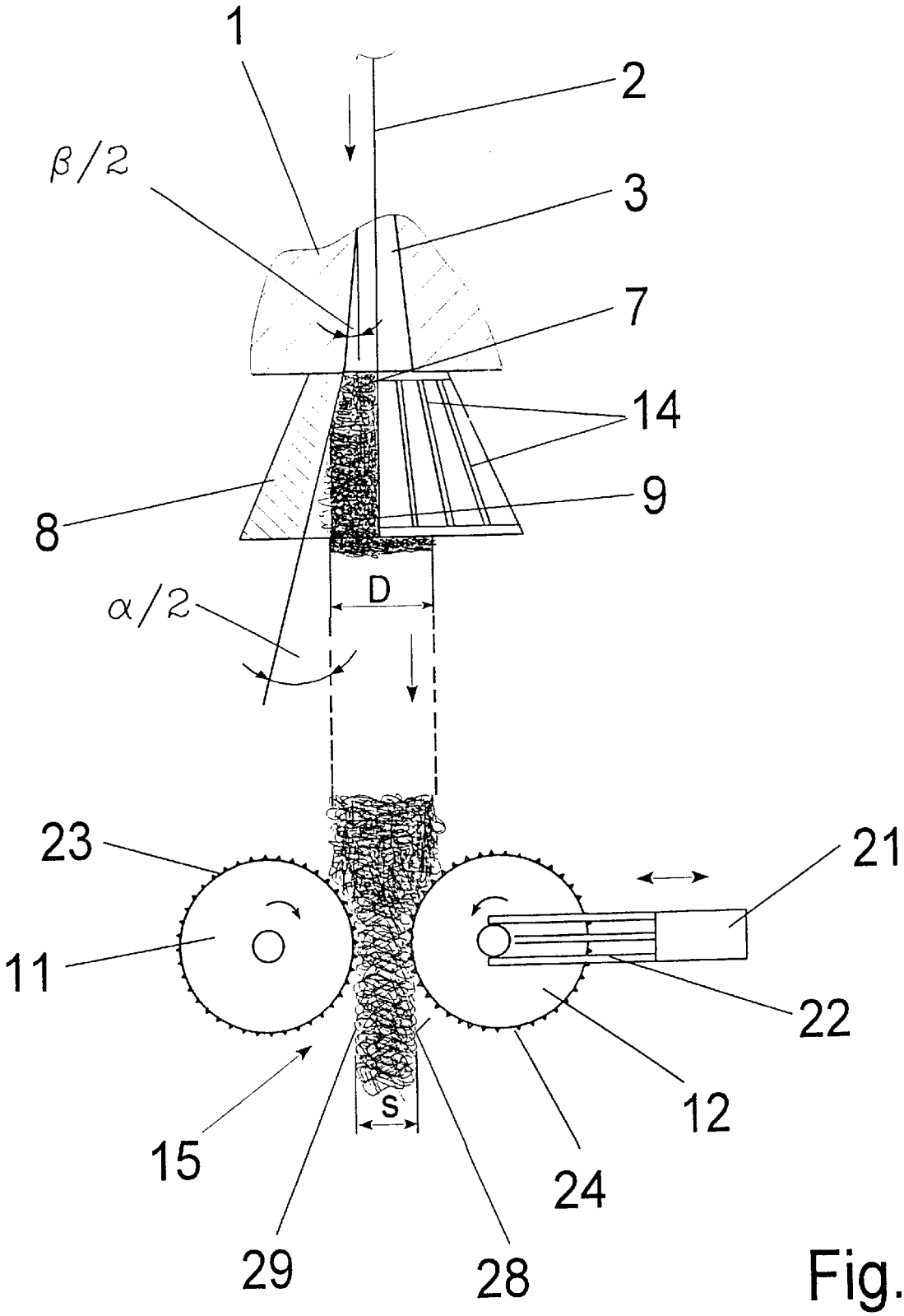
FIG. 3 is a schematic sectional view of a further embodiment of the apparatus according to the invention without cooling device.

FIG. 3 is a schematic view of a further embodiment of the apparatus according to the invention. The conveying nozzle 1 and stuffer box 7 downstream thereof are identical with the embodiment of FIG. 1. To this extent, the description of FIG. 1 is herewith incorporated by reference.

The conveying nozzle 1 terminates with the yarn duct 3 in stuffer box 7. The yarn duct 3 has a cross section that increases in the direction of advance toward the stuffer box 7. In this connection, an apex angle $\beta$ ranges from 0.5° to 5°, preferably to 2°. FIG. 3 shows the apex angle in the cross section of the yarn with $\frac{1}{2}\beta$. This configuration accomplishes that the velocity of flow of the conveying medium is substantially maintained along the yarn duct. Thus, high tensions are able to build up on the yarn. In the stuffer box 7 downstream thereof, the yarn is deposited on the plug surface and compressed by the conveying medium flowing into the stuffer box 7.

The stuffer box 7 is formed by wall 8. FIG. 3 is a part sectional view of stuffer box 7. The stuffer box 7 has a cross section that increases from the inlet to the outlet. Thus, the diameter D of the yarn plug is formed by the cross section of stuffer box 7. To this end, the stuffer box wall 8 is arranged at an apex angle $\alpha$. In the half sectional view of FIG. 3, the apex angle $\alpha$ is indicated at $\alpha/2$. The apex angle $\alpha$ is realized such that no significant cohesive forces build up by friction between the stuffer box wall 8 and the yarn plug 9. Thus the resistance to the forward pressure in the yarn plug resulting from the heated conveying medium in the stuffer box is provided essentially only by the force on the yarn plug generated by its compression in the gap of the rolls 11, 12.

The stuffer box wall 8 is made permeable to air, so that the conveying medium is allowed to flow out of the stuffer box 7 upstream of the yarn plug. To this end, a plurality of substantially parallel, elongate slots 14 are arranged in stuffer box wall 8. The elongate slots 14 extend through the stuffer box wall 8 at least over a partial length of stuffer box 7.

The outflowing conveying medium causes individual filaments to be drawn in part into the elongate slots 14. To ensure that the filaments can be included in the yarn plug, the stuffer box wall 8 is constructed with an increasing wall thickness.

The yarn plug 9 is withdrawn from the stuffer box by paired rolls 10 and advanced to a cooling device not shown in FIG. 3. The pair of rolls 10 shown in FIG. 3 comprises again rolls 11 and 12. In this embodiment, the roll 11 has on its surface a gear-tooth system 23. Likewise, a gear-tooth system 24 extends over the circumference of roll 12. Between them, the rolls form conveying gap 15, which has a substantially constant width s due to the cylindrical shape of rolls 11 and 12. The roll 12 is coupled with an adjustment device 21 and supported in a guideway 22 such that the adjustment device permits displacement of the conveying roll crosswise to the direction of advance. Thus, it is possible to vary the conveying gap in its width s.

The gear-tooth systems 23 and 24 on the circumferential surfaces of rolls 11 and 12 break up the yarn plug despite the compression on its surfaces 28 and 29. During the subsequently cooling, a cooling air stream is directed to the plug transversely to its compressed surfaces. Due to the discontinuous compressed surfaces, a substantially more intensive cooling occurs on the yarn plug, which results in a shortening of the cooling zone.

Figure 4:
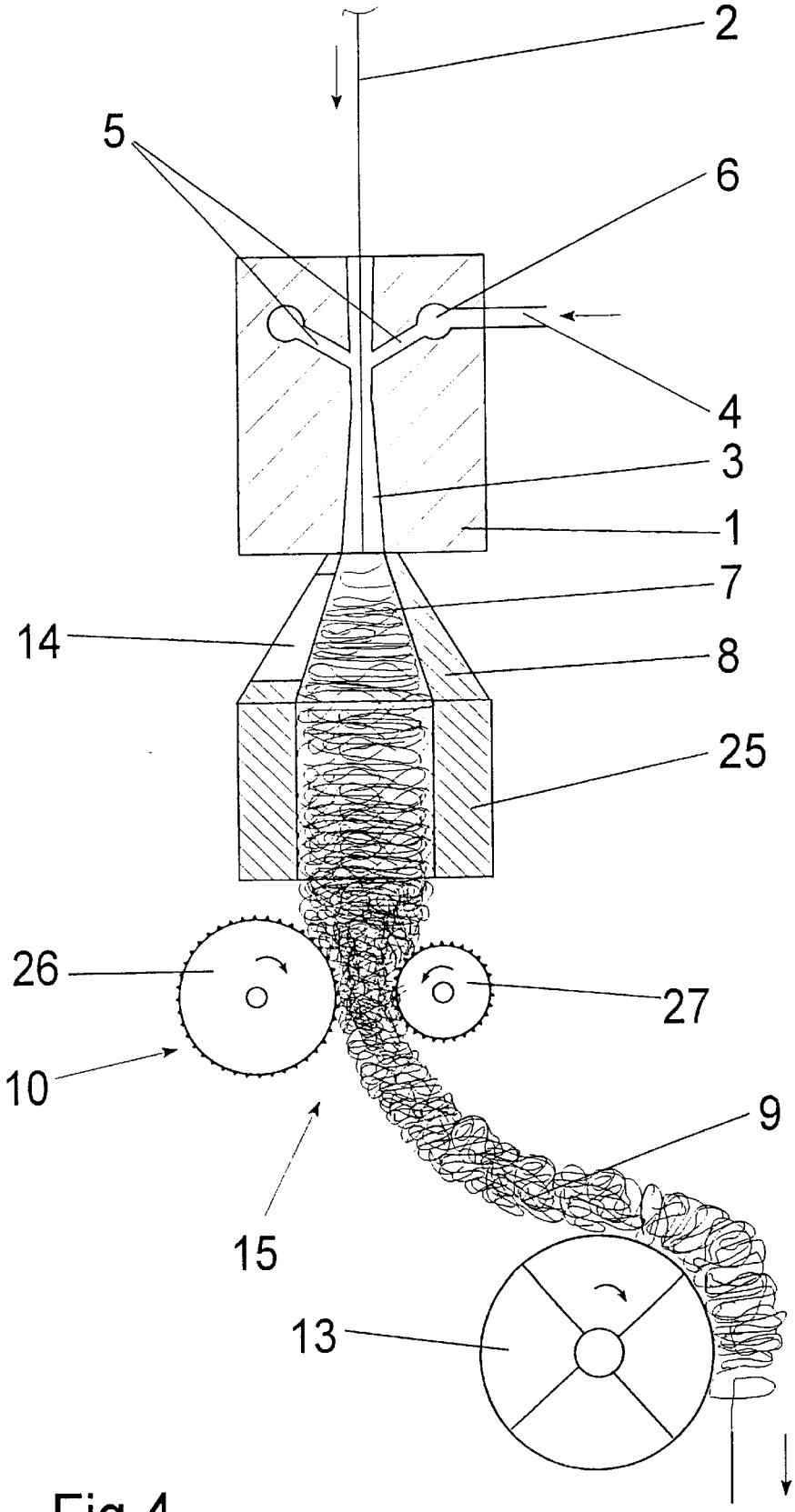
FIG. 4 is a schematic sectional view of a further embodiment of the apparatus according to the invention.

FIG. 4 is a schematic, axially sectioned view of a further embodiment of the apparatus in accordance with the invention. The conveying nozzle 1 and the stuffer box 7 are identical with the embodiment of FIG. 1. To this extent, the description of FIG. 1 is herewith incorporated by reference.

In the embodiment shown in FIG. 4, a tube 25 connecting directly to the outlet of stuffer box 7 extends between stuffer box 7 and paired rolls 10. The pair of rolls 10 is arranged at the outlet end of tube 25. The pair of rolls 10 comprises rolls 26 and 27. Between them, the rolls form the conveying gap 15. The roll 27 has a smaller diameter than the roll 26. Both rolls are driven at the same rotational speed. Due to the smaller circumference of roll 27, the yarn plug advances on the side of roll 27 at a lower speed. On the opposite side, roll 26 advances the yarn plug at a certain circumferential speed. The difference between the two circumferential speeds results in that the yarn plug is deflected, when it leaves the conveying gap 15. This deflection is especially of advantage for depositing the yarn plug with its compressed surface on a subsequent, rotating cooling drum. The speed difference on the two compressed surfaces of the yarn plug leads in addition to a loosening of the yarn plug.

In the embodiment shown in FIG. 4, the tube 25 serves to increase the dwelling time of the heated yarn plug, in particular to perform a shrinkage treatment of the yarn. In this connection, the tube 25 could be heated in addition. However, it is also possible to direct hot air that flows crosswise to the direction of advance, through the tube with porous walls for a thermal treatment of the yarn plug.

The embodiments of the apparatus according to the invention as shown in FIGS. 1–4, are all suitable for carrying out the method of the present invention. They permit crimping yarns, in particular carpet yarns of polyamide, polypropylene, or polyester. The yarns distinguish themselves in particular by an intensive and homogeneous crimp.

That which is claimed:

1. An apparatus for stuffer box crimping a synthetic multifilament yarn comprising a yarn conveying nozzle which includes a yarn duct having an inlet end and an outlet end, and a passageway for introducing a pressurized fluid into the duct so as to advance a yarn which is introduced into the inlet end of the duct through the duct and the outlet end thereof, a stuffer box disposed adjacent the outlet end of the duct for receiving the advancing yarn exiting from the duct and forming the same into a yarn plug, the stuffer box comprising a perforated circumferential wall which defines an internal passage therethrough which extends from an inlet end to an outlet end and which is positioned to receive the advancing yarn in the inlet end and form the yarn into a yarn plug, with the cross section of the passage increasing in the direction of advance such that no significant cohesive force is imparted to the yarn by the passage wall, and such that the yarn plug leaving the stuffer box passage at the outlet end thereof has a predetermined plug diameter, a pair of rolls rotatably mounted adjacent the outlet end of the passage of the stuffer box, with said rolls defining a conveying gap for receiving the yarn plug therethrough, and wherein said conveying gap of said rolls is less than the plug diameter.

2. The apparatus as defined in claim 1 wherein the stuffer box defines an inlet end region adjacent said inlet end of the stuffer box, and wherein the plug diameter is defined by the cross section of the inlet end region of the stuffer box.

3. The apparatus as defined in claim 2 wherein the conveying gap of said rolls is less than 0.9 times the plug diameter.

4. The apparatus as defined in claim 3 wherein the internal passage of the stuffer box is conical and has an apex angle greater than 2°.

5. The apparatus as defined in claim 4 wherein the rolls are each cylindrical.

6. The apparatus as defined in claim 4 wherein the rolls each include a roughened circumferential surface for engaging the yarn plug.

7. The apparatus as defined in claim 6 wherein the roughened surface is defined by axially directed grooves.

8. The apparatus as defined in claim 6 wherein the roughened surface is formed by a gear tooth system in the roll surface.

9. The apparatus as defined in claim 2 further comprising a drive for rotating at least one of the pair of rolls at a variable circumferential speed.

10. The apparatus as defined in claim 2 further comprising means adjustably mounting at least one of the rolls so as to permit the width of the conveying gap to be varied.

11. The apparatus as defined in claim 2 wherein the cross section of the yarn duct of the yarn conveying nozzle continuously increases at a substantially constant apex angle from a narrowest point in the yarn duct to the outlet end thereof.

12. The apparatus as defined in claim 11 wherein the apex angle is between about 0.5° to 5°.

13. The apparatus as defined in claim 2 wherein the perforated circumferential wall of the stuffer box comprises a plurality of elongate slots extending through the wall and along the direction of yarn advance, with the slots being distributed evenly about the circumference of the wall.

14. The apparatus as defined in claim 13 wherein the circumferential wall increases in thickness in the direction of the yarn advance, so that the stuffer box exhibits outwardly a substantially conical shape.

15. The apparatus as defined in claim 2 further comprising a yarn cooling device for cooling the advancing yarn plug after it has exited from outlet end of the passage of the stuffer box.

16. The apparatus as defined in claim 15 wherein the cooling device includes a rotatable cooling drum over which the yarn plug is passed.

17. A method for stuffer box crimping a synthetic multifilament yarn comprising the steps of advancing the yarn with a heated conveying gas into a passage which extends through a stuffer box wherein the yarn is compressed into the form of a yarn plug, withdrawing the yarn plug from the stuffer box and guiding the yarn plug into contact with a cooling device, and after leaving the stuffer box and before contacting the cooling device, compressing the yarn plug substantially transversely to its direction of advance, and wherein the passage through the stuffer box has a cross section that increases in the direction of the yarn advance so that no significant cohesive force develops on the yarn in the passage and the resistance to the pressure in the yarn plug resulting from the heated conveying gas is provided essentially only by the force on the yarn plug generated in the compressing step.

18. The method as defined in claim 17 wherein the compressing step includes compressing the yarn plug between two surfaces by at least 10%.

19. The method as defined in claim 18 wherein the compressing step results in two compressed surfaces on the yarn plug, and wherein one of the compressed surfaces is guided into contact with the cooling device.

* * * * *